United States Patent [19]

Hind

[11] 4,358,034

[45] Nov. 9, 1982

[54] SLIDING GATE VALVE WITH ORIFICE-ENCIRCLING SPRING

[75] Inventor: Robert D. Hind, Rotherham, England

[73] Assignee: USS Engineers and Consultants, Inc., Pittsburgh, Pa.

[21] Appl. No.: 114,815

[22] Filed: Jan. 24, 1980

[30] Foreign Application Priority Data

Mar. 2, 1979 [GB] United Kingdom ..... 7907429

[51] Int. Cl.[3] ..... B22D 41/08

[52] U.S. Cl. ..... 222/600; 222/512

[58] Field of Search ..... 222/600, 512, 561; 251/144, 174; 266/272

[56] References Cited

U.S. PATENT DOCUMENTS

| | | | |
|---|---|---|---|
| 3,604,603 | 9/1971 | Grosko et al. | 222/600 |
| 3,926,406 | 12/1975 | Hind | 222/600 X |
| 4,076,153 | 2/1978 | Tinnes | 222/600 |
| 4,189,073 | 2/1980 | Lothmann | 222/600 |
| 4,294,437 | 10/1981 | Sawada et al. | 266/272 |

FOREIGN PATENT DOCUMENTS 863183 1/1953 Fed. Rep. of Germany ..... 251/174

OTHER PUBLICATIONS

Berry, W. R., *Spring Design, a Practical Treatment*; Emmott & Co., Ltd. 1961, pp. 239–243

Chironis, N. P., *Spring Design and Application*; McGraw-Hill, 1961 pp. 178–180.

*Primary Examiner*—David A. Scherbel

*Attorney, Agent, or Firm*—John F. Carney

[57] ABSTRACT

Apparatus for applying a clamping force to slide gate valve plates to prevent leakage of molten metal therebetween. The apparatus applies the force uniformly about the annulus of the orifice of the plates and at a location close to the orifice itself, thus providing more effective clamping of the parts together. The apparatus may be either an annular mechanical spring mounted about the orifice of the plates or an annular chamber filled with gas under pressure.

4 Claims, 5 Drawing Figures

SLIDING GATE VALVE WITH ORIFICE-ENCIRCLING SPRING

The present invention concerns improvements relating to sliding gate valves.

Sliding gate valves to which the invention relates, for controlling the pouring of molten metal, are well established in the art. The valves include a set of orificed refractory valve members or plates which are held in face-to-face contact. The valve plates are relatively movable to align and misalign their orifices, thus to open and close the valves to metal flow. One category of sliding gate valve has two valve plates. The upstream plate is stationary, being immovably mounted at the pour opening of a molten metal pouring vessel, and the downstream plate is slidingly movable. Another category of valve has three valve plates; again, the upstream plate is immovable. The downstream plate is also immovable and its orifice is aligned with the upstream plate orifice. An intermediate valve plate is sandwiched between the two stationary plates, and is slidingly movable therebetween to control metal flow through the valve. In known valves of the foregoing categories, the movable "gate" plate may be reciprocally movable along a straight or curved path in contact with the stationary plate or plates.

Leakage of molten metal into the interfacial regions between valve plates must be avoided, inter alia on the grounds of safety. Avoidance of leakage demands the plates have and retain accurately mating sliding surfaces and the presence of means which positively urge the plates into face-to-face contact.

Coil springs have been used to bias the plates together, but are less than perfect. They are particularly prone to losing temper at the elevated temperature to which they are exposed, and so they must be replaced frequently at some considerable expense. Inevitably during use the valve parts wear and as this happens, the coil springs relax to an undesirable degree so that the required plate loading thrust falls.

Commonly, a plurality of coil springs, e.g. eleven, are provided at intervals around the orificed region of the valve. Space considerations demand that the distance between the springs and the flow orifice is substantial. A consequence of this is that the spring bias is remote from where it is needed, and may be unable to counteract the effects of thermal distortion of the plates which can develop at the elevated temperatures. Thermal distortion may even be encouraged by the multi-point loading pattern provided by a plurality of springs, especially where these may exert differing thrusts due to inherent differences between apparently identical springs.

An object of the present invention is to provide a valve with spring means which overcome the aforementioned drawbacks.

Preferably, the spring means should have such spring characteristics that, over a limited range of deflection of the spring means, the operating thrust developed remains substantially invariant. This is particularly important in enabling the accumulation of manufacturing tolerances to be accommodated within the desired thrust range and also to allow wear to take place within safe operating limits without causing the plate loading to depart from safe operating limits.

According to the present invention, there is provided a sliding gate valve for controlling molten metal flow from a vessel containing metal melt, wherein means, other than a helical coil spring, which bias the relatively-movable valve plates into face-to-face sliding contact comprise a resilient annular spring member which completely encircles the orifice area in the downstream one of the valve plates and is disposed between the downstream plate and a fixed abutment, the annular spring member exerting biasing force along substantially the whole of its circumferential extent on the said downstream plate.

In some valves, a discharge nozzle depends from the downstream plate. The encircling spring member can be arranged both to bias the valve plates together and to hold the nozzle, if this is detachable from the downstream plate, in a liquid-tight manner to the downstream plate.

Preferably, the spring member is one or more Belleville washers having cone height/thickness ratios within the range 0.4 to 1.4. The said ratio can be 1.0.

Aternatively, the spring member could be an axially expansible, annular chamber filled with gas under pressure, the chamber being defined by spaced apart end walls interconnected by inner and outer flexible bellows. Two inner and two outer bellows could be used, to provide the chamber with double-skinned inner and outer walls to guard against accidental depressurization.

The present invention will now be described by way of example only with reference to the accompanying drawings, in which.

Figure 1:
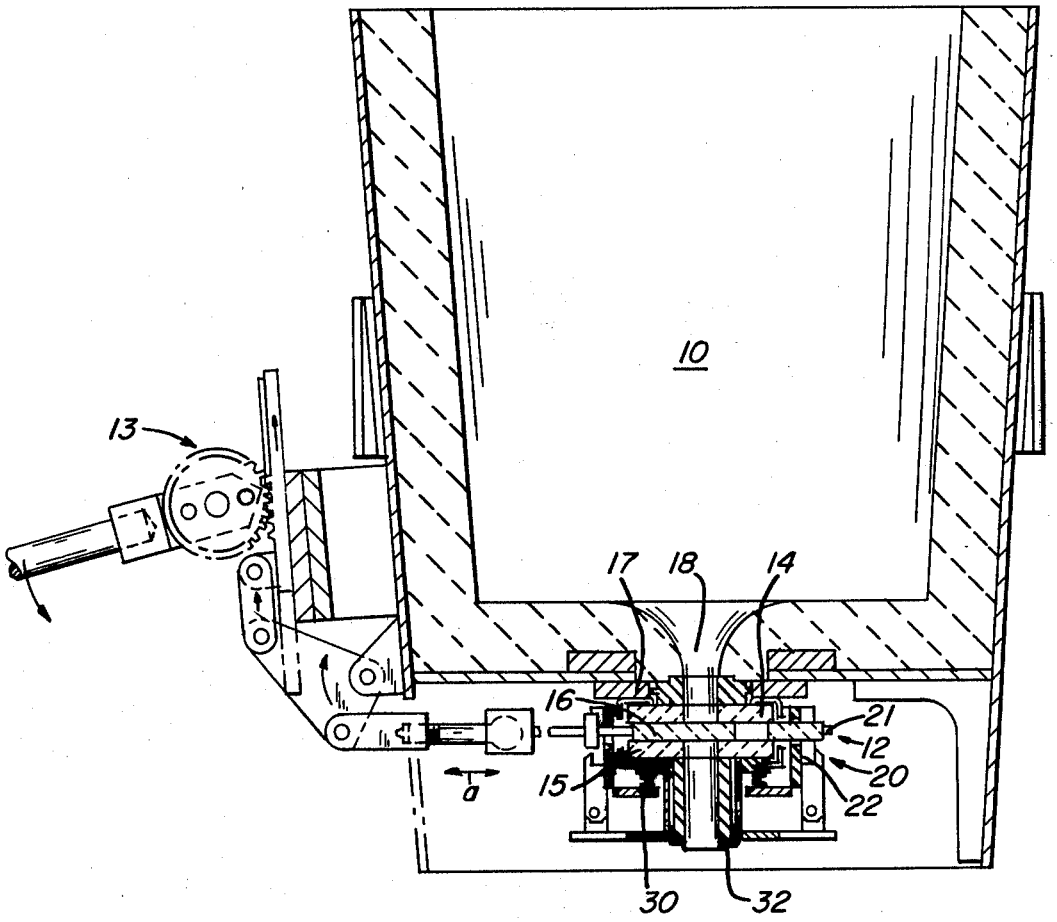
FIG. 1 is a part-sectional view through a bottom pour ladle fitted with a sliding gate valve embodying the invention.

In FIG. 1 of the drawings is illustrated a generally conventional bottom pour ladle 10 for molten metal which is fitted to a slide gate valve 12. Features of the valve will be more clearly seen in the enlarged illustrations of FIGS. 2 to 5. The parts of the valve 12 are shown arranged in FIG. 1 for valve closure preventing flow of metal from the ladle 10, and in FIGS. 2 and 3 for fully opening the valve to metal flow. By suitably operating a valve actuator 13, it is possible to open the valve only partly for metering metal flow therethrough. The valve actuator 13 is a manually-operable system involving a rack-and-pinion drive with appropriate levers to transmit movement therefrom to the valve to operate same. As shown, the system features a bell-crank drive lever. A detailed description of actuator 13 is omitted since it is not germane to the invention. An electric, hydraulic or pneumatic actuator could be substituted if desired. The valve 12 presently under consideration is a three-plate valve, that is it has three orificed refractory plates 14, 15 and 16 held in face-to-face contact. The two orifices in the first and second plates 14 and 15, which are stationarily mounted in the valve, are aligned. The third plate 16 is sandwiched between the first and second plates 14, 15 and its orifice can be brought into and out of registry with the said two aligned orifices, to open and close the valve, by to and fro sliding movement of the third plate 16 relative to the stationary plates 14, 15. Movement of plate 16 is accomplished by operating the actuator 13. Movement of the slidable plate to either side of a central valve-open position thereof can be arranged to accomplish valve closure.

The valve 12 is secured to the bottom of the ladle 10 by a valve mounting plate 17, the plate 17 serving to locate the first stationary or head plate 14 with its orifice maintained in alignment with a pour opening 18 of the ladle 10. Suspended from mounting plate 17 is an assembly 20 of valve parts including the second and third plates 15, 16 and a slide carriage 21 in which the third or slide plate is seated. The slide carriage 21 is linearly reciprocally movable in a frame 22 in which the second or bottom plate 15 is seated. The direction of movement of the carriage 20 and slide plate 16 is indicated in the drawings by the arrow a.

The said assembly 20 is suspended from the mounting plate 17 by releasable toggle linkages (not shown). The arrangement is such that in an operative condition of the linkages, spring member (30) is under load and is caused resiliently to urge the assembly 20 upwardly towards the mounting plate 17. As shown here, the spring member 30 is disposed between plate 15 and a bottom part of frame 22 and it encircles a depending discharge nozzle 32. In a released condition, the linkages allow the assembly to drop away from the mounting plate 17 to allow the valve to be serviced and worn refractory parts to be replaced.

Figure 2:
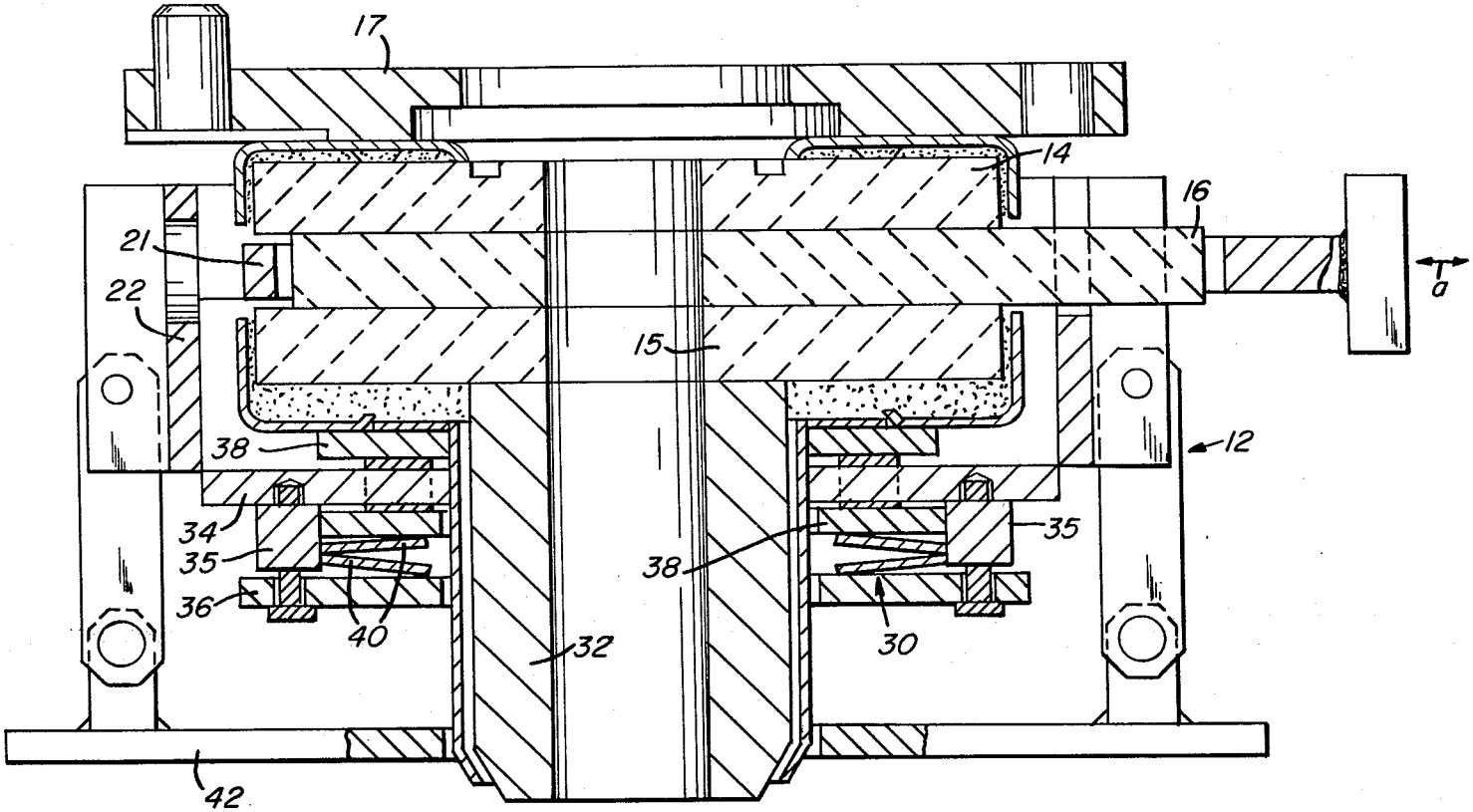
FIG. 2 is a sectional view through a valve embodying the invention.

One way of organizing spring member 30 is shown in FIG. 2, in which the spring member is disposed beneath the bottom 34 of frame 22. Secured to and depending from the bottom 34 are a plurality of posts 35. A spring reaction plate 36 of annular form is mounted on the posts 35. Acting between the plate 36 and a thrust-transmitter 38 of annular form is the spring member 30. The thrust transmitter 38 is mounted in the bottom 34 so as to be free to move vertically, and it abuts the underside of the bottom stationary valve plate 15. It will be understood that the action of spring member 30 is to thrust upwardly on the plates 14, 15 and 16 through thrust transmitter 38. The upward thrust is, of course, resisted by valve mounting plate 17. Accordingly, the spring member 30 urges the three valve plates 14 to 16 into firm face-to-face engagement with each other.

The spring member 30 in this instance is comprised of a pair of Belleville washers or disc springs 40, arranged in series. Depending on the exact loading and spring characteristics required, the Belleville washers could be arranged in parallel. One Belleville washer might suffice, and more than two may be preferred. Preferably, an even number of Belleville washers is chosen. As shown, the Belleville washers 40 closely encompass the discharge nozzle 32. The posts 35 are positioned so as to locate and center the washers 40 with respect to the centerline through the valve flow path.

Mounting the Belleville washers below the frame bottom 34 is advantageous since they are shielded well from the hot ladle 10 thereabove. Moreover, they are in a position in which cooling air may readily be blown over them, should cooling be considered necessary or desirable. Heat radiated from melt poured into a mould can be shielded from the Belleville washers by a conventional heat shield 42.

Figure 3:
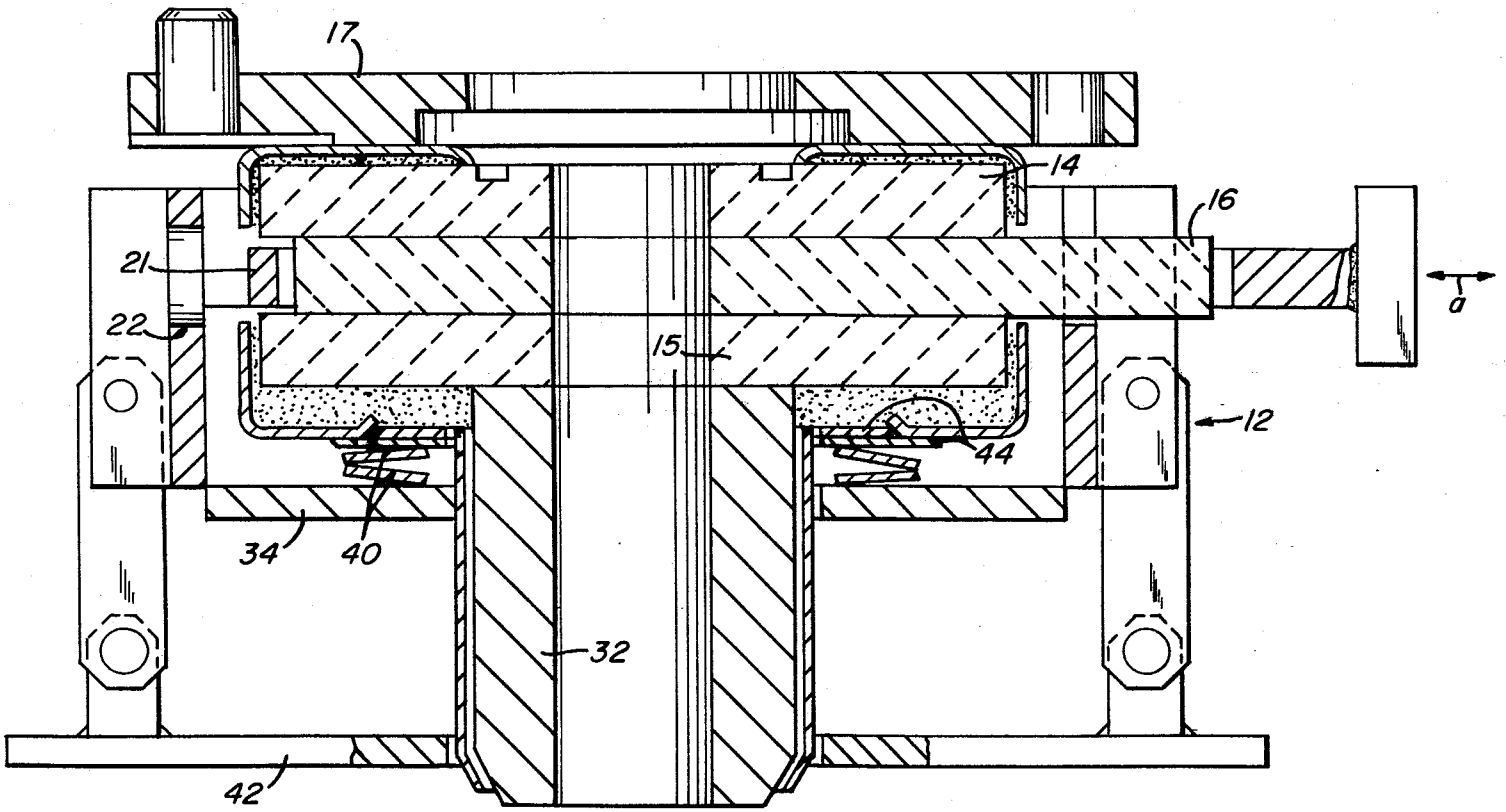
FIG. 3 is a view similar to FIG. 2 showing a simplified construction of the valve.

If spring cooling requirements allow, the spring member 30 can be arranged more simply as suggested in FIG. 3. Here, series-coupled Belleville washers 40 are sandwiched between frame bottom 34 and annular thrust plates 44 which directly engage the underside of the bottom valve plate 15. Centering means (not shown) may be incorporated in the construction for properly locating the Belleville washers.

The Belleville washers 40 can be made from a heat resisting steel, stainless steel or a heat resisting, nonferrous alloy such as Nimonic 90.

The washers are so designed that, in service, the thrust they exert on the valve plates 14 to 16 remains sensibly constant over a limited range of deflection. The object of this is to allow the washers 40 to expand slightly to accommodate wear of the valve parts without the thrust they exert substantially changing. Such non-linear load/deflection characteristics can be attained with suitably designed Belleville washers when their cone height to thickness ratios (h/t) are greater than 0.4. The preferred ratio may be 1.0 or even more, e.g. 1.4. Over 1.4, a Belleville washer will exhibit a snap action whereby it inverts or turns inside out. The normally preferred maximum value of h/t is therefore not greater than 1.4. Washers having h/t values greater than 1.4 might nevertheless be tolerated if the valve is so designed, in the region where the Belleville washers are located, as to prevent inversion.

A small foundry ladle, having a 1 to 15 ton melt capacity may have a valve 12 with a flow passage of 21 to 28 mm diameter and be required to discharge its contents in 15 to 20 minutes. A valve suitable for such a ladle may require a spring member 30 which exerts an upthrust of 500 to 600 lbs along the whole or substantially the whole of its circumferential extent. At the loading figure specified by the designer, 2 mm deflection may be provided without substantial change in the specified figure to allow for wear.

Figure 4:
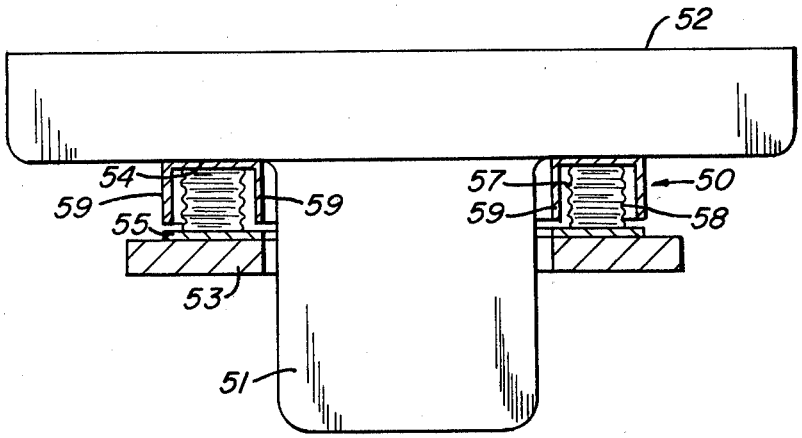
FIG. 4 is a diagrammatic view of part of a valve embodying an annular gas spring member.
Figure 5:
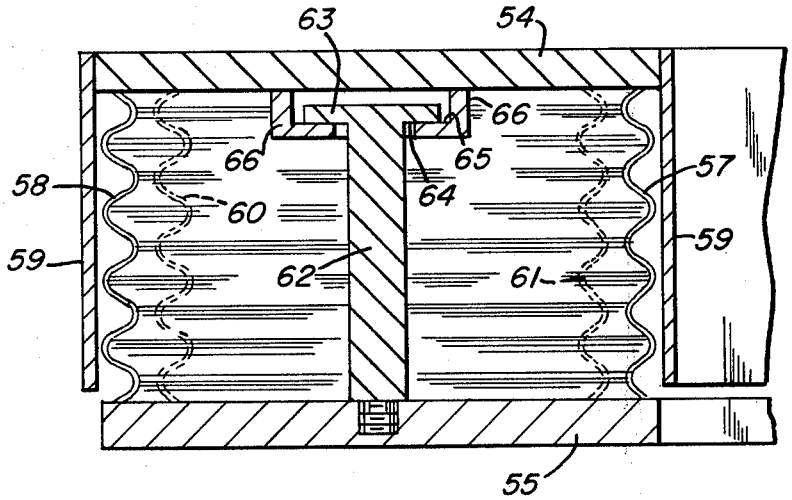
FIG. 5 is an enlarged cross-sectional view through the gas spring member.

Another embodiment of the invention is illustrated in the simplified drawings of FIGS. 4 and 5. Here, the annular spring member 50, which encompasses the discharge nozzle 51 depending from the lower valve plate 52, is a gas spring. Gas spring member 50 thrusts upwardly against the underside of plate 52 and the reaction force is taken up by reaction member 53. Member 53 can be the bottom of the carriage frame numbered 22 in FIGS. 1 to 3.

Gas spring member 50 is an annular, axially-resilient chamber filled with gas under pressure. The gas can be one of the inert gases, e.g. $N_2$ or Ar, and its pressure at room temperature can be around 30 atmospheres. The chamber is defined by two axially-spaced apart end walls 54, 55, an inner generally cylindrical bellows 57 and an outer generally cylindrical bellows 58. The bellows are joined in a leak-tight manner to the end walls 54, 55. The end walls 54, 55 thrust in opposite directions on the valve plate 52 and reaction member 53 respectively. To avoid the bellows 57, 58 being inadvertently damaged, the end wall 54 has depending protective skirts 59.

Although the risk of depressurization caused by failure of one or other bellows is small, it may be desired to guard against this eventuality. To do so, the inner and outer walls defining the chamber can be double skinned. Thus, bellows 57, 58 can be duplicated by adjacently-disposed bellows 60, 61, see FIG. 5.

The spring member 50 is provided with means to prevent complete collapse thereof in the event of depressurization. The said means comprise a plurality of rigid pillars 62 which project from one end wall and terminate adjacent the other end wall. There may be four such pillars positioned at 90° intervals around the spring member 50. As shown, the pillars are screwed to end wall 55 but clearly they could be secured to end wall 54 instead.

The spring member 50 is also provided with means to prevent excessive axial expansion, e.g. when the spring member is being filled with its gaseous charge and before it is installed under load in the valve. The pillars 62 are adapted to cooperate with the end wall 54 for this purpose.

Thus, pillars 62 are provided with enlarged heads 63 which define downwardly-facing shoulders 64. These shoulders 64 are abuttable with upwardly-facing shoulders 65 formed by a flanged element 66 fast with the underside of the end wall 54.

It will be appreciated that, in use, the elevated temperatures to which the spring member 50 is exposed will raise the initial pressure of the gas filling. Thus, the valve can be assembled cold relatively easily, the service temperature being allowed to "top-up" the thrust developed to the designed valve. Instead of being disadvantageous, the elevated temperatures can be regarded as positively helpful.

In practicing the invention, the spring members 30, 50 closely encompass the orifice in the lowermost plate, so as to ensure that the thrust exerted is confined as far as practical to the critical area in which interfacial leakage may commence. With this arrangement, onset of thermal distortion of the valve plates is effectively discouraged.

If the invention is embodied in a sliding gate valve having two valve plates, the spring members 30, 50 should be arranged to move with the movable downstream plate.

I claim:

1. In a sliding gate valve for controlling the flow of molten metal from the pour opening of a bottom pour teeming vessel including means forming a valve frame suspended from the bottom of said vessel about the pour opening thereof, said frame containing a pair of vertically spaced orificed refractory plates having their orifices vertically aligned with said vessel pour opening, a gate formed of an orificed refractory plate movably disposed between said vertically spaced plates and means for moving said gate relative to said spaced plates to displace the orifice in said gate into and out of registry with the orifices in said spaced plates, the improvement comprising means for spring biasing said refractory plates into mutual face-to-face sliding contact, said means including:

(a) a fixed plate suspendedly attached to said frame;

(b) a thrust transmitter operatively positioned between said fixed plate and the lowermost of said pair of refractory plates and engaging the same annularly about the orifice therein; and (c) spring means seated on said fixed plate and operative to provide an upward bias seriatim to said thrust transmitter, said lowermost refractory plate and said gate.

2. The organization of claim 1 in which said fixed plate is a reaction plate suspendedly attached beneath the bottom of said frame and in which said thrust transmitter comprises a pair of vertically spaced annular plates disposed each on opposite sides of said bottom of said frame and interconnected by circumferentially spaced connecting rods slidably received in openings in said frame bottom plate.

3. The organization of claim 2 in which said spring means is a Belleville spring.

4. The organization of claim 3 in which said reaction plate is suspended from said frame bottom plate by a plurality of circumferentially spaced posts disposed about the periphery of said spring and said thrust transmitter.

* * * * *